US008227961B2

(12) United States Patent
van de Ven

(10) Patent No.: US 8,227,961 B2
(45) Date of Patent: Jul. 24, 2012

(54) LIGHTING DEVICE WITH REVERSE TAPERED HEATSINK

(75) Inventor: Antony Paul van de Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 126 days.

(21) Appl. No.: 12/794,559

(22) Filed: Jun. 4, 2010

(65) Prior Publication Data

US 2011/0298350 A1 Dec. 8, 2011

(51) Int. Cl.
*H01J 1/02* (2006.01)

(52) U.S. Cl. ..... 313/46

(58) Field of Classification Search ..... 313/46, 313/498, 512

See application file for complete search history.

(56) References Cited

U.S. PATENT DOCUMENTS

| | | | |
|---|---|---|---|
| 6,350,041 | B1 | 2/2002 | Tarsa et al. |
| 6,465,961 | B1 | 10/2002 | Cao |
| 6,634,770 | B2 | 10/2003 | Cao |
| 6,746,885 | B2 | 6/2004 | Cao |
| 7,086,756 | B2 | 8/2006 | Maxik |
| 7,224,001 | B2 | 5/2007 | Cao |
| 2005/0068776 | A1 | 3/2005 | Ge |
| 2005/0073244 | A1 | 4/2005 | Chou et al. |
| 2006/0198147 | A1 | 9/2006 | Ge |
| 2007/0263405 | A1 | 11/2007 | Ng et al. |
| 2008/0285270 | A1 | 11/2008 | Chiang |
| 2009/0016062 | A1 | 1/2009 | Lee et al. |
| 2009/0296387 | A1 | 12/2009 | Reisenauer et al. |
| 2009/0302730 | A1 | 12/2009 | Carroll et al. |
| 2010/0207502 | A1 | 8/2010 | Cao et al. |
| 2011/0121707 | A1 | 5/2011 | Fan |

FOREIGN PATENT DOCUMENTS

| | | | |
|---|---|---|---|
| CN | 101363610 | A | 2/2009 |
| EP | 2177812 | A1 | 4/2010 |
| JP | 2005-166578 | A | 6/2005 |
| JP | 2005166578 | A | 6/2005 |
| JP | 2010-73438 | A | 4/2010 |
| KR | 10-2010-0009909 | A | 1/2010 |
| KR | 10-1017349 | B1 | 2/2011 |
| KR | 10-2011-0117090 | A | 10/2011 |
| WO | 2008134056 | A2 | 11/2008 |
| WO | 20090135359 | A1 | 11/2009 |

OTHER PUBLICATIONS

General Electric Co., LED Lighting Press Release, Apr. 14, 2010, accessed at "http://www.geconsumerproducts.com/pressroom/press_releases/lighting/led_lighting/2010_LED_A_Line.htm".

General Electric Co., LED Lighting Press Release, Apr. 14, 2010, "GE Energy smart LED Omnidirectional lightdistribution comparison", p. 1, accessed at "http://www.geconsumerproducts.com/pressroom/press_releases/lighting/led_lighting/2010_LED_A_Line.htm".

(Continued)

*Primary Examiner* — Vip Patel

(74) *Attorney, Agent, or Firm* — Vincent K. Gustafson; Jenkins, Wilson, Taylor & Hunt, P.A.

(57) ABSTRACT

A solid state lighting devices includes a heatsink having a first end arranged proximate to a base end, and a second end arranged between the first end and a solid state emitter, wherein at least a portion of the heatsink is wider at point intermediate the first end and the second end than the width of the heatsink at the second end. Such reverse angled heatsink reduces obstruction of light. A heatsink may include multiple fins and a heatpipe.

35 Claims, 4 Drawing Sheets

OTHER PUBLICATIONS

Popular Science Online Article, "Updating Edison: All over light", Image 2 of 4, Jul. 30, 2010, p. 1, accessed at http://www.popsci.com/gadgets/gallery/2010-07/updating-edison.

PSFK Online Article, "GE's Low Power. Long Lasting LED Bulb," Apr. 14, 2010, accessed at http://www.psfk.com/2010/04/ges-low-power-long-lasting-led-bulb.html.

Unpublished U.S. Appl. No. 12/796,549.

Unpublished U.S. Appl. No. 12/796,555.

International Search Report issued in International Patent Application No. PCT/US2011/039105 on Sep. 28, 2011.

European Search Report issued in corresponding European Patent Application No. 12 15 2917 dated Mar. 5, 2012.

Supplementary European Search Report issued in corresponding European Patent Application No. 11 79 0482 dated Mar. 12, 2012.

Korean Office Action issued on May 3, 2012 in Korean Patent Application No. 10-2012-703774 (based on International Patent Application No. PCT/US2011/039105).

LIGHTING DEVICE WITH REVERSE TAPERED HEATSINK

FIELD OF THE INVENTION

The present invention relates to solid state lighting devices and heat transfer structures relating to same.

DESCRIPTION OF THE RELATED ART

Light emitting diodes (LEDs) are solid state devices that convert electric energy to light, and generally include one or more active layers of semiconductor material sandwiched between oppositely doped layers. When bias is applied across doped layers, holes and electrons are injected into one or more active layers where they recombine to generate light that is emitted from the device. Laser diodes are solid state emitters that operate according to similar principles.

Solid state light sources may be utilized to provide colored (e.g., non-white) or white LED light (e.g., perceived as being white or near-white). White solid state emitters have been investigated as potential replacements for white incandescent lamps. A representative example of a white LED lamp includes a package of a blue LED chip (e.g., made of InGaN and/or GaN), coated with a phosphor (typically YAG:Ce or BOSE) that absorbs at least a portion of the blue light and re-emits yellow light, with the combined yellow and blue emissions providing light that is perceived as white or near-white in character. If the combined yellow and blue light is perceived as yellow or green, it can be referred to as 'blue shifted yellow' ("BSY") light or 'blue shifted green' ("BSG") light. Addition of red spectral output from a solid state emitter or lumiphoric material (e.g., phosphor) may be used to increase the warmth of the white light. As an alternative to phosphor-based white LEDs, combined emission of red, blue, and green solid state emitters and/or lumiphors may also be perceived as white or near-white in character. Another approach for producing white light is to stimulate phosphors or dyes of multiple colors with a violet or ultraviolet LED source. A solid state lighting device may include, for example, at least one organic or inorganic light emitting diode and/or laser.

Many modern lighting applications require high power solid state emitters to provide a desired level of brightness. High power LEDs can draw large currents, thereby generating significant amounts of heat that must be dissipated. Heat dissipating elements such as heatsinks are commonly provided in thermal communication with high intensity LEDs, since is necessary to prevent a LED from operating at an unduly high junction temperature in order to increase reliability and prolong service life of the LED. For heatsinks of substantial size and/or subject to exposure to a surrounding environment, aluminum is commonly employed as a heatsink material, owing to its reasonable cost, corrosion resistance, and relative ease of fabrication. Aluminum heatsinks for solid state lighting devices are commonly formed in various shapes by casting, extrusion, and/or machining techniques. Lead-frame-based solid state emitter packages also utilize chip-scale heatsinks typically being arranged along a single non-emitting (e.g., lower) package surface to promote thermal conduction to a surface on which the package is mounted. Such chip-scale heatsinks are generally used as intermediate heat spreaders to conduct heat to other device-scale heat dissipation structures, such as cast or machined heatsinks. Chip-scale heatsinks may include at least portions thereof encased in a molded encasing material, in contrast to device-scale heatsinks that are typically devoid of any portion that is encased in a molded encasing material.

For solid state lighting device heatsinks of substantial size and/or that are subject to exposure to a surrounding environment, aluminum is commonly employed as a heatsink material and may be formed in various shapes by casting, extrusion, and/or machining techniques.

It would be desirable to provide a LED light bulb capable of replacing an incandescent bulb without sacrificing light output characteristics, but various limitations have hindered widespread implementation of LED light bulbs. In the context of a conventional high-output LED light bulb, at least a portion of a heatsink is arranged between the base and globe (or cover) portions of the bulb, with the globe or cover typically serving to protect the LED and diffuse light emitted therefrom. Unfortunately, a heatsink of sufficient size to dissipate the quantity of heat generated by the LED(s) tends to block output of light proximate to the base of the bulb. Examples of solid state lighting devices embodying heatsinks arranged between cover and base portions thereof are illustrated in FIG. 6 and FIGS. 7A-7B.

FIG. 6 illustrates a first conventional LED light bulb 550 including a base portion 563 having an associated foot contact 565 and a lateral (threaded) contact 566 for mating with an electrical receptacle, a globe or cover 580 defining an interior volume containing at least one LED, and a heatsink 590 extending between the cover 580 and the base portion 563, with the heatsink including multiple fins 594. An upper boundary 591 of the heatsink 590 provides a linear boundary arranged perpendicular to a central vertical axis definable through the bulb 550, and a lower boundary 592 of the heatsink 590 is disposed adjacent to the base portion 563. The widest point of the heatsink 590 is along the upper boundary 591 thereof, as the width or lateral dimension of the heatsink 590 decreases continuously in a direction from the upper boundary 591 toward the lower boundary. Proximate to the upper boundary 591 of the heatsink 590 is arranged a lower boundary 581 of the cover 580. Typical emissions of a conventional LED light bulb according to FIG. 6 are over a full angle of approximately 135 degrees, but certainly less than 180 degrees (equal to half-angle emissions of approximately 67.5 degrees, but certainly less than 90 degrees), since the heatsink 590 blocks direct emissions below the horizontal upper boundary 591 of the heatsink. Half angle emissions in this context refers to an angle between (a) a central vertical axis definable through the bulb and (b) a lowest unreflected beam transmitted by at least one LED beyond a lateral edge of the bulb.

When a LED light bulb 550 as illustrated in FIG. 6 is placed pointing upward in a table lamp, the resulting low intensity of light output in an area below the bulb and shadows are not pleasing to many users FIGS. 7A-7B illustrate a LED light bulb 650 according to a second conventional design (which has been publicized as the new 9-watt GE Energy Smart® LED bulb, but not yet commercially released), with the bulb including a base portion 663 having an associated foot contact 665 and a lateral (threaded) contact 666 for mating with an electrical receptacle, a globe or cover 680 defining an interior volume containing at least one LED, and a heatsink 690 that extends between the cover 580 and the base portion 563, and further includes multiple (i.e., seven) fins 694 that extend upward along exterior surfaces of the globe or cover 680. An upper boundary 691 of the fins 694 is arranged well above a lower boundary 681 of the globe or cover 680, with a widest portion of the heatsink 690 disposed at or about the lower boundary 681 of the globe or cover 680. The fins 694 are lightly colored (i.e., white) to reflect light. Although half-angle emissions of the bulb 650 may be greater than those provided by the bulb 550 illustrated in FIG. 6, the fins 694 of the heatsink serve to obstruct a portion of the light emitted by at least one LED disposed within the globe or cover 680.

It would be desirable to enhance light output proximate to the base of a LED light bulb. It would further be desirable to provide such enhanced light output without obstructing lateral emissions the LED light bulb.

SUMMARY OF THE INVENTION

The present invention relates in various embodiments to solid state lighting devices comprising heatsinks with portions that increase in width along a direction extending from solid state emitters to base ends of the lighting devices, in order to reduce obstruction of light emitted by the solid state lighting devices and increase half-angle emissions.

In one aspect, the invention relates to a solid state lighting device comprising: a base end; at least one solid state emitter; and a heatsink disposed between the base end and the at least one solid state emitter, and arranged to dissipate heat generated by the at least one solid state emitter; wherein: the heatsink has a first end proximate to the base end, and has a first width at the first end; the heatsink has a second end disposed between the base end and the at least one solid state emitter, and has a second width at the second end; and at least a portion of the heatsink disposed between the first end and the second end has a third width that is greater than the second width.

In another aspect, the invention relates to a solid state lighting device comprising: a base end; at least one solid state emitter; and a heatsink disposed between the base and the at least one solid state emitter, and arranged to dissipate heat generated by the at least one solid state emitter; wherein the lighting device has a substantially central axis extending in a direction between the base end and an emitter mounting area in which the at least one solid state emitter is mounted; wherein the heatsink is arranged to permit unobstructed emission of light generated by the at least one solid state emitter according to each emission half-angle of greater than 90 degrees relative to the central axis around an entire lateral perimeter of the solid state lighting device.

In a further aspect, the invention relates to a heatsink for use with a solid state lighting device having a base end and at least one solid state emitter, the heatsink comprising: a first end arranged for placement proximate to the base end of a lighting device, the first end having a first width; and a second end arranged for placement between the first end and the at least one solid state emitter of the lighting device, the second end having a second width; wherein at least a portion of the heatsink disposed between the first end and the second end has a third width that is greater than the second width.

In another aspect, any of the foregoing aspects and/or other features and embodiments disclosed herein may be combined for additional advantage.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
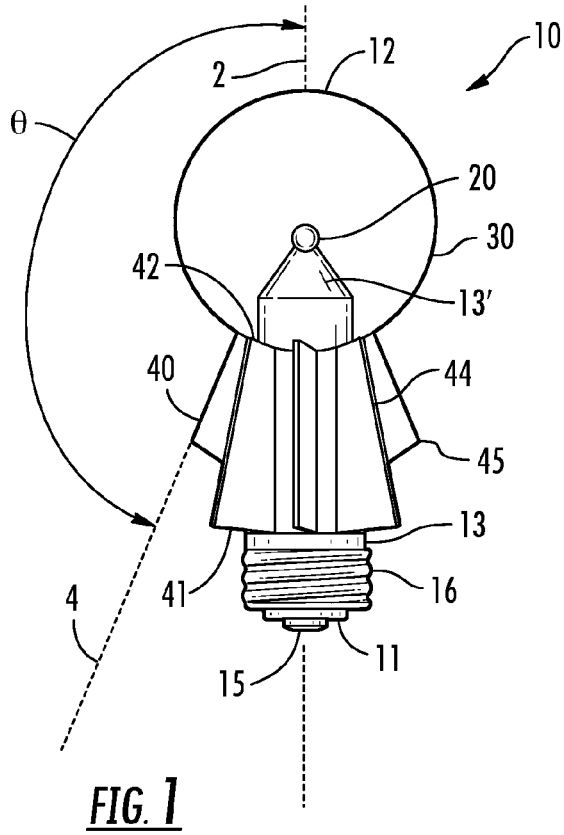
FIG. 1 is a schematic elevation view of a first LED light bulb including a reverse tapered heatsink including at least a portion thereof with a width that increases in a direction extending from a solid state emitter to a base end, according to one embodiment of the present invention

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the drawings, the size and relative sizes of layers and regions may be exaggerated for clarity.

Unless otherwise defined, terms (including technical and scientific terms) used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Unless the absence of one or more elements is specifically recited, the terms "comprising," "including," and "having" as used herein should be interpreted as open-ended terms that do not preclude presence of one or more elements.

As used herein, the terms "solid state light emitter" or "solid state light emitting device" may include a light emitting diode, laser diode and/or other semiconductor device which includes one or more semiconductor layers. A solid state light emitter generates a steady state thermal load upon application of an operating current and voltage to the solid state emitter. Such steady state thermal load and operating current and voltage are understood to correspond to operation of the solid state emitter at a level that maximizes emissive output at an appropriately long operating life (preferably at least about 5000 hours, more preferably at least about 10,000 hours, more preferably still at least about 20,000 hours).

Solid state light emitters may be used individually or in combinations, optionally together with one or more luminescent materials (e.g., phosphors, scintillators, lumiphoric inks) and/or filters, to generate light of desired perceived colors (including combinations of colors that may be perceived as white). Inclusion of luminescent (also called lumiphoric') materials in LED devices may be accomplished by adding such materials to encapsulants, adding such materials to lenses, or by direct coating onto LEDs. Other materials, such as dispersers and/or index matching materials, may be included in such encapsulants.

The term "device-scale heatsink" as used herein refers to a heatsink suitable for dissipating heat substantially all of the steady state thermal load from at least one chip-scale solid state emitter to an ambient environment, with a device-scale heatsink having a minimum major dimension (e.g., height, width, diameter) of about 5 cm or greater, more preferably about 10 cm or greater.

The term "chip-scale heatsink" as used herein refers to a heatsink that is smaller than and/or has less thermal dissipation capability than a device-scale heatsink. A lighting device may include one or more chip-scale heatsinks as well as a device scale heatsink.

The present invention relates in various aspects to solid state lighting devices including device-scale heatsinks arranged to reduce obstruction of light emitted by at least one solid state emitter. Conventional solid state emitter-based light bulbs employ heatsinks having a widest dimensions proximate to a solid state emitter, wherein width of the heatsink is reduced along a direction extending from the solid state emitter to a base end of the light bulb. Contrary to such conventional practice, devices according to the present invention include heatsinks with portions that increase in width along a direction extending from the solid state emitter to a base end of the light bulb. The resulting reverse tapered heatsink reduces obstruction of light emitted by the solid state lighting devices and increases half-angle emissions, thereby providing enhancing light output (e.g., in an area below the lighting device when such device is pointed upward).

Device-scale heatsinks according to preferred embodiments are adapted to dissipate substantially all of the steady state thermal load of one or more solid state emitters to an ambient environment (e.g., an ambient air environment). Such heatsinks may be sized and shaped to dissipate significant steady state thermal loads (preferably at least about 4 watts, more preferably at least about 8 watts, and more preferably at least about 10 watts) to an ambient air environment, without causing excess solid state emitter junction temperatures that would detrimentally shorten service life of such emitter(s). For example, operation of a solid state emitter at a junction temperature of 85° C. may provide an average solid state emitter life of 50,000 hours, while temperatures of 95° C., 105° C., 115° C., and 125° C. may result in average service life durations of 25,000 hours, 12,000 hours, 6,000 hours, and 3,000 hours, respectively. In one embodiment, a device-scale stamped heatsink is adapted to dissipate a steady state thermal load at least about 2 Watts (more preferably at least about 4 Watts, still more preferably at least about 10 watts) in an ambient air environment of about 35° C. while maintaining a junction temperature of the solid state emitter at or below about 95° C. (more preferably at or below about 85° C.). The term "junction temperature" in this context refers to an electrical junction disposed on a solid state emitter chip, such as a wirebond or other contact. Device-scale heatsinks may be fabricated by suitable fabrication techniques including casting, stamping, extruding, machining, forging, welding/brazing, and the like.

In one embodiment, a solid state lighting device having a base end and at least one solid state emitter includes a heatsink having a first end proximate to the base end, and having a second end disposed between the base end and the at least one solid state emitter. The heatsink has a first width at the first end, a second width at the second end, and at least a portion of the heatsink disposed between the first end and the second end has a third width that is greater than the second width. In other words, a second end of the heatsink disposed between a base end and the at least one emitter is relatively narrow, and a portion of the heatsink closer to the base end is relatively wider. Such reverse tapering reduces obstruction of light by the heatsink. Such reverse tapering may apply to the entire heatsink, or only to a portion thereof. In one embodiment, a heatsink comprises multiple reversed tapered portions (i.e., with a width that increases, then decreases and increases again with distance from a second end proximate to at least one solid state emitter toward a first end proximate to a base end of the heatsink) sequentially arranged between a base end and at least one solid state emitter.

In one embodiment, a solid state lighting device includes a substantially central axis extending in a direction between the base end and an emitter mounting area, and heatsink is arranged to permit unobstructed emission of light generated by the at least one solid state emitter according to at least one large emission half-angle relative to the substantially central axis around an entire lateral perimeter of the solid state lighting device. This large emission half-angle is preferably at least about 90 degrees, more preferably at least about 120 degrees, more perfectly still at least about 135 degrees, and even more preferably at least about 145 degrees.

In certain embodiments, a heatsink may provide a substantially symmetrical optical obstruction profile relative to the substantially central axis. In other embodiments, a heatsink may provide a non-symmetrical optical obstruction profile relative to the substantially central axis, with one or more portions of the heatsink arranged to permit transmission of or obstruct light in a manner that differs with respect to direction. An upper portion of a heatsink may be flat, curved, or offcut at an angle to provide a desired pattern of obstruction or transmission of light.

In one embodiment, a base end of a solid state lighting device includes at least one electrical contact (preferably multiple contacts) arranged to receive current from an electrical receptacle (e.g., a socket of a light fixture or plug). Such contacts may be in the form of a foot contact and an lateral contact suitable for mating with a threaded light socket, in the form of protruding pin-type contacts, in the form of terminals for receiving wires or other conductors, or any other suitable type of contacts. Multiple electrical conductors and/or electrical circuit elements may be disposed in or on heatsink, such as in a channel or cavity defined in the heatsink, or arranged in or along a surface of a heatsink. Such conductors and/or circuit elements be used to conduct current to, and to facilitate control of, at least solid state emitter of the solid state lighting device.

In preferred embodiments, a heatsink comprises multiple fins. Such thin may be configured and arranged in any suitable manner. In one embodiment, multiple fins are arranged as outwardly-protruding pins or rods. In one embodiment, multiple fins are arranged substantially parallel to a substantially central axis defined through the base end and an emitter mounting area. In one embodiment, multiple fins are arranged substantially perpendicular to a the substantially central axis. In one embodiment, a heatsink includes at least one fin arranged in a spiral shape. Fins of different sizes, shapes, and/or conformations may be arranged on a single heatsink.

In one embodiment, a heatsink includes a sealed heatpipe arranged for transport of heat with an internal working fluid. Multiple fins may be arranged and conducted thermal communication with the heatpipe.

Figure 8:
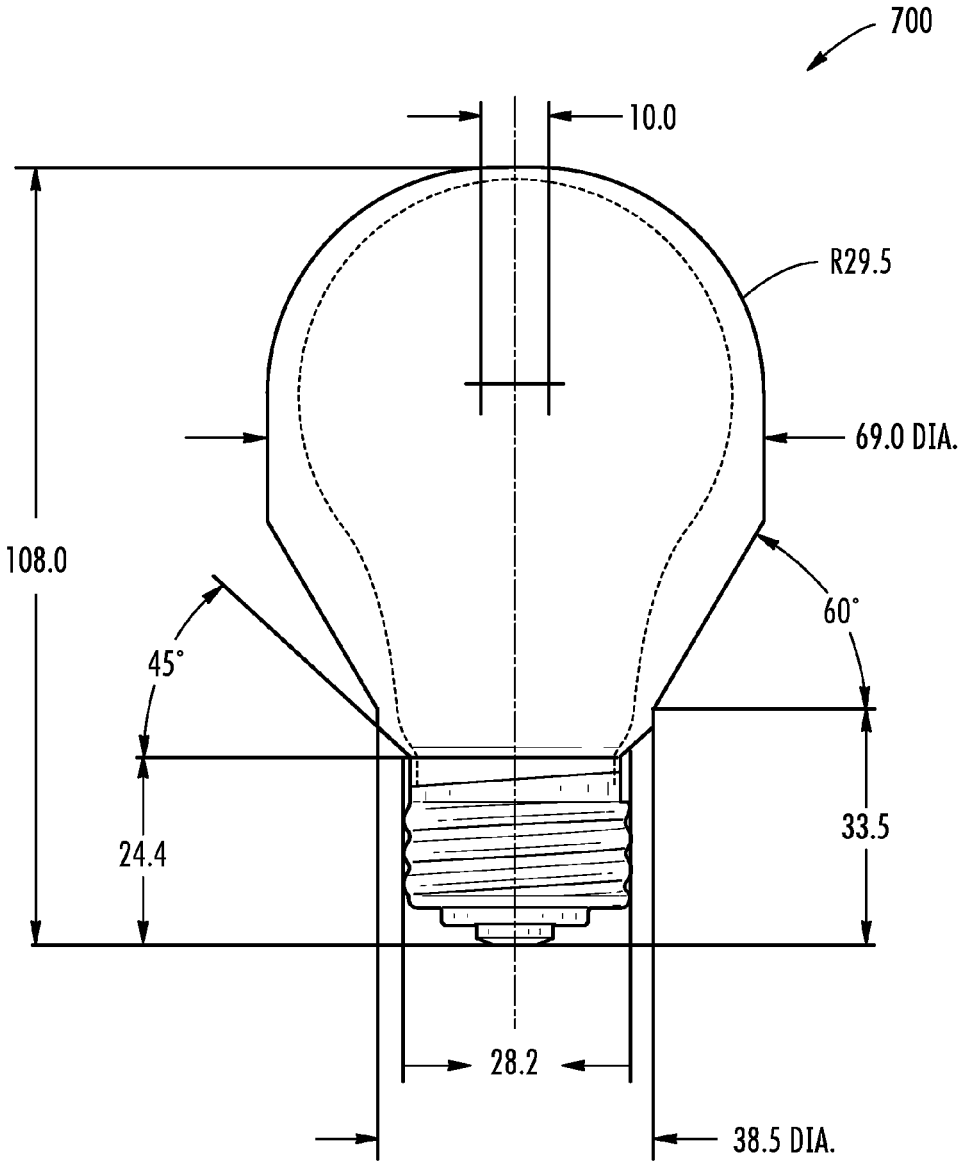
FIG. 8 RELATED ART
FIG. 8 is an excerpt from ANSI Standard C.78.20-2003 showing exterior dimensions (in millimeters) for an A19 bulb according to such standard.

In certain embodiments, a solid state lighting device including a heatsink as described herein is sized and shaped in accordance with a bulb standard defined by ANSI Standard 0.78.20-2003, such as, but not limited to, A19 bulbs. FIG. 8 is an excerpt from ANSI Standard 0.78.20-2003 showing exterior dimensions (in millimeters) for an A19 bulb 700 according to such standard. A solid state lighting device as described herein may include multiple solid state emitters, and such emitters may be independently controlled.

In one embodiment, a solid state lighting device including a heatsink as described herein includes at least one solid state emitter disclosed under or within an at least partially transmissive cover. A cover may be formed of any suitably transmissive material such as (but not limited to) polymeric materials and/or glass. Such cover may comprise a diffuser or arranged to diffuse light emitted by one or more solid state emitters. Such cover may include a lens to provide focusing, directional pointing, or light shaping utility. A Such cover may alternatively, or additionally, include one or more lumiphors (e.g., phosphors) arranged to interact with light emitted by one or more LEDs. A cover may be symmetric or intentionally asymmetric in character. A cover associated with a solid state lighting device including a heatsink is described herein may be provided in any suitable size or shape, including planar, spherical, hemispherical, and the like. At least a portion of such a cover may resemble a globe in shape. In one embodiment, a cover may have an outer dimension (e.g., height and/or width) that is approximately equal to a corresponding dimension of an associated heatsink. In another embodiment, a cover may have an outer dimension that is substantially less than a corresponding dimension of a heatsink—such as less than about one half, less than about one fourth, or less than about one fifth the corresponding dimension of the heatsink.

Referring to the drawings, FIG. 1 illustrates a solid state lighting device 10 in the form of a LED light bulb (or lamp) according to one embodiment of the present invention. The bulb 10 includes a base end 11 and a distal end 12, with first and second electrical contacts (i.e., a foot contact 15 and a lateral (threaded) contact 16 arrange proximate to the base end 11, and with a cover 30 closer to the distal end 20 and arranged to cover at least one solid state emitter 20. At least one column or emitter support structure 13, 13' may be provided proximate to the heatsink 40. Between the solid state emitter 20 and the base and 11 is arranged a reverse tapered heatsink 40 including multiple fins 44. The heatsink 40 includes a first end 41 arranged proximate to the base end 11 of the lighting device 10, and includes a second end 42 arranged between the first end 41 and the solid state emitter 20. The widest portion 45 of the heatsink 40 is arranged between the first end 41 and the second end 42. The LED light bulb 10 provides emissions along a half angle θ extending between a substantially central vertical axis 2 and a linear projection 4 from the solid state emitter 20 the widest portion 45 of the heatsink 45. As is evident from FIG. 1, the LED light bulb 10 is arranged to provide unobstructed emissions over a half angle θ of substantially more than 90 degrees; such half angle θ exceeds 135 degrees.

Figure 2:
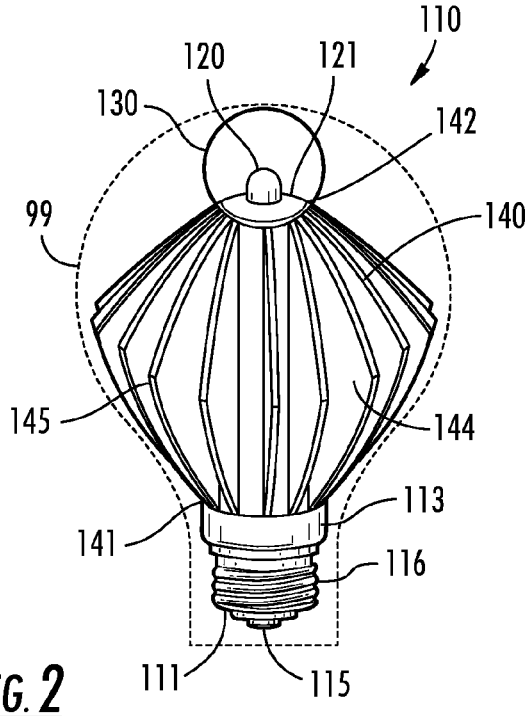
FIG. 2 is a schematic perspective view of a second LED light bulb including a reverse tapered heatsink including at least a portion thereof with a width that increases in a direction extending from a solid state emitter to a base end, according to another embodiment of the present invention, including a superimposed dashed outline of an A19 bulb (according to ANSI Standard C.78.20-2003).

Referring to FIG. 2, a LED light bulb 110 according to another embodiment includes at least one solid state emitter 120 and associated substrate 121 disposed under a cover 130 that is significantly smaller than an associated reverse tapered heatsink 140, but the resulting size and shape of the bulb is within the dimensional envelope of ANSI Standard C.78.20-2003 for A19 bulbs, as shown by the superimposed dashed outline 99. A foot contact 115 and a lateral (threaded) contact 116 are arranged along a base end 111. At least one column or emitter support structure 113 may extend from the base end 111 toward (and optionally through) the reverse tapered heatsink 140 including multiple fins 144 (arranged vertically, parallel to a central vertical axis of the bulb 110). The heatsink 140 includes a first end 141 arranged proximate to the base end 111, and includes a second end 142 arranged between the first end 141 and the at least one solid state emitter 120. The widest portion 145 of the heatsink 140 is arranged between the first end 141 and the second end 142. Width of the heatsink 140 proximate to the at least one solid state emitter 120 is small, and such width increases with distance away from the emitter 120 to the widest point 145; below the widest point 145, the width of the heatsink 140 decreases with distance away from the emitter 120.

Figure 3:
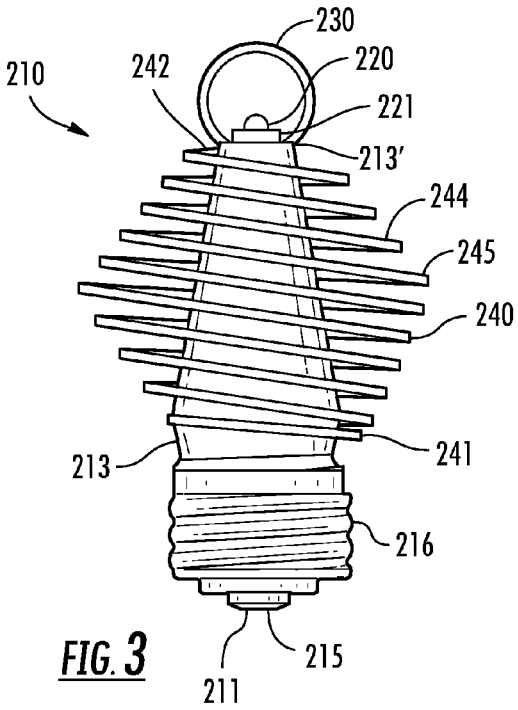
FIG. 3 is a schematic elevation view of a third LED light bulb including a reverse tapered heatsink formed in a spiral shape including at least a portion thereof with a width that increases in a direction extending from a solid state emitter to a base end, according to another embodiment of the present invention.

FIG. 3 shows another LED light bulb 210 including a reverse tapered heatsink 240 with at least one fin 244 arranged in a spiral shape, with the resulting size and shape of the bulb being within the dimensional envelope of ANSI Standard C.78.20-2003 for A19 bulbs. At least one solid state emitter 220 and associated substrate 121 are disposed under a cover 230. A foot contact 215 and a lateral (threaded) contact 216 are arranged along a base end 211. At least one column or emitter support structure 213, 213' may extend from the base end 211 toward (and optionally through) the reverse tapered heatsink 140. The heatsink 240 includes a first end 241 arranged proximate to the base end 311, and includes a second end 242 arranged between the first end 241 and the at least one solid state emitter 220. The widest portion 245 of the heatsink 240 is arranged between the first end 241 and the second end 242. Width of the heatsink 240 proximate to the at least one solid state emitter 220 is small, and such width increases with distance away from the emitter 220 to the widest point 245; below the widest point 245, the width of the heatsink 240 decreases with distance away from the emitter 220. The reverse angled heatsink 240 reduces obstruction of light in comparison to a traditional heatsink.

Figure 4:
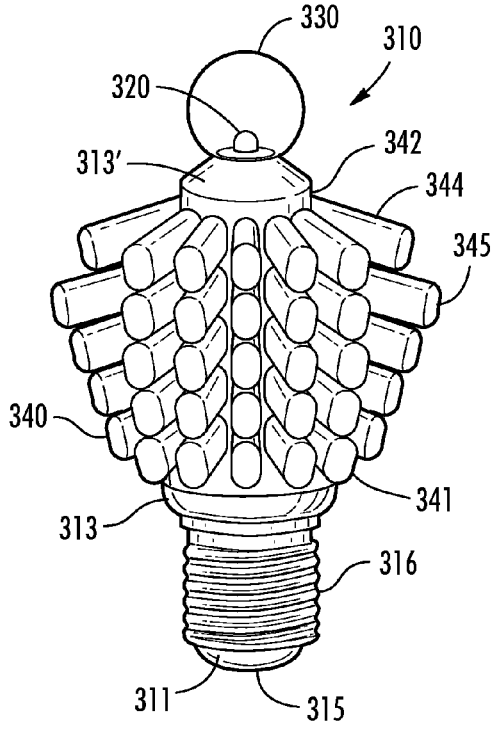
FIG. 4 is a schematic perspective view of a fourth LED light bulb including a reverse tapered heatsink comprising fins arranged as a plurality of protruding pins or rods, the heatsink including at least a portion thereof with a width that increases in a direction extending from a solid state emitter to a base end, according to another embodiment of the present invention.

Another LED light bulb 310 is illustrated in FIG. 4. The light bulb 310 includes a reverse tapered heatsink 340 with multiple fins 344 arranged as rods or pins projecting laterally outward relative to a central vertical axis definable through the bulb 310, with the resulting size and shape of the bulb being within the dimensional envelope of ANSI Standard C.78.20-2003 for A19 bulbs. At least one solid state emitter 320 is disposed under a cover 330. A foot contact 315 and a lateral (threaded) contact 316 are arranged along a base end 311. At least one column or emitter support structure 313, 313' may extend from the base end 311 toward (and optionally through) the reverse tapered heatsink 340. The heatsink 340 includes a first end 341 arranged proximate to the base end 311, and includes a second end 342 arranged between the first end 341 and the at least one solid state emitter 320. The widest portion 345 of the heatsink 340 is arranged between the first end 341 and the second end 342. Width of the heatsink 340 proximate to the at least one solid state emitter 320 is small, and such width increases with distance away from the emitter 320 to the widest point 345; below the widest point 345, the width of the heatsink 340 decreases with distance away from the emitter 320. The reverse angled heatsink 240 reduces obstruction of light in comparison to a traditional heatsink.

Figure 5:
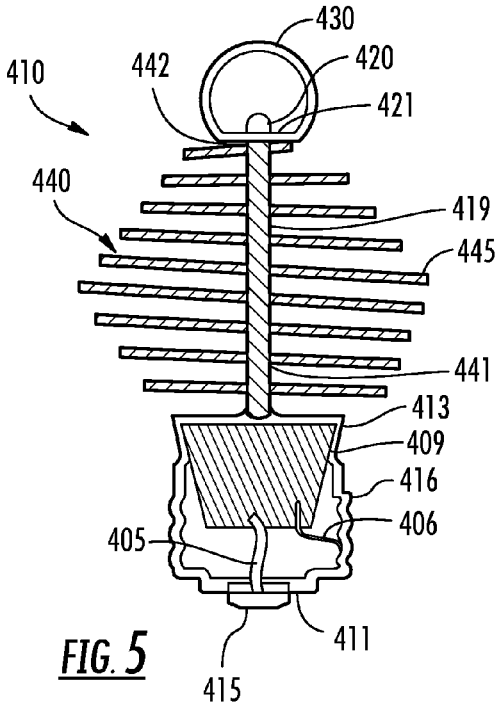
FIG. 5 is a schematic cross-sectional view of a fifth LED light bulb including a reverse tapered heatsink comprising fins arranged perpendicular to a central heatpipe, the heatsink including at least a portion thereof with a width that increases in a direction extending from a solid state emitter to a base end, according to another embodiment of the present invention.
Figure 6:
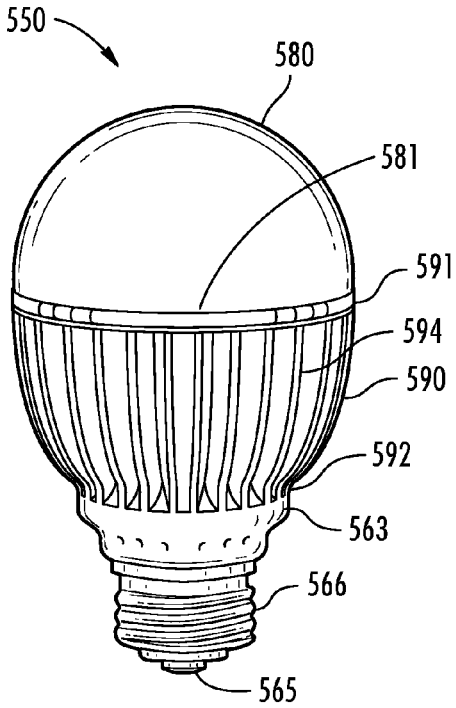
FIG. 6 RELATED ART
FIG. 6 is a perspective view of a first conventional LED light bulb known in the art, the bulb including a heatsink with multiple fins disposed between a globe or cover and a base portion thereof.
Figure 7A:
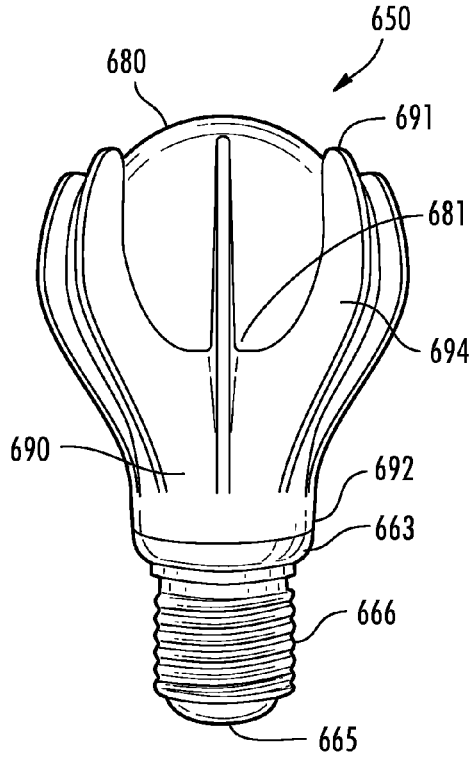
FIG. 7A RELATED ART
FIG. 7 is a side elevation view of a second conventional LED light bulb according to a design known in the art, the bulb including a heatsink with multiple fins that extends between a globe or cover and a base portion, and further includes multiple fins that extend upward along exterior surfaces of the globe or cover.
Figure 7B:
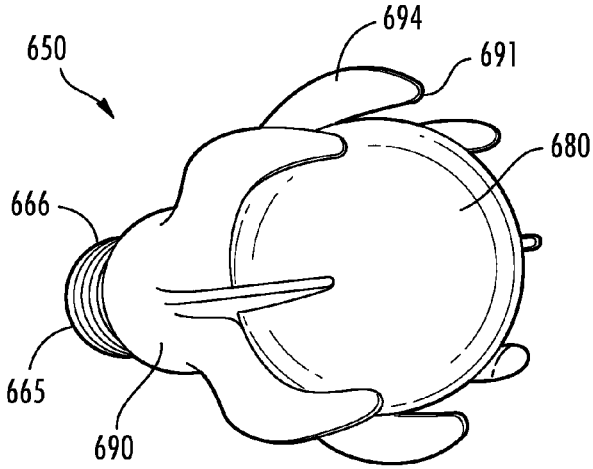
FIG. 7B RELATED ART

Yet another LED light bulb 410 is illustrated in cross-sectional schematic view in FIG. 5. The light bulb 410 includes a reverse tapered heatsink 440 with multiple fins 444 extending horizontally outward relative to a central vertical axis definable through the bulb 410, with the resulting size and shape of the bulb being within the dimensional envelope of ANSI Standard C.78.20-2003 for A19 bulbs. At least one solid state emitter 420 is disposed under a cover 430. A foot contact 415 and a lateral (threaded) contact 416 are arranged along a base end 411. At least one column or emitter support structure 413 may extend upward relative to the base end 411. Such column or support structure 413 is hollow and includes conductors 405, 406 in electrical communication with the foot contact 415 and lateral contact 416, respectively. At least one electrical circuit element and/or control element 409 (optionally including any of a ballast, a dimmer, a color control circuit, and a temperature protection circuit) is further arranged within the column or support structure 413.

A central portion of the heatsink 440 includes a heatpipe 419, with the fins 444 in conductive thermal communication with the heatpipe 419. The heatpipe 419 is arranged to transport heat away from the solid state emitter 420, and such heat is dissipated laterally outward by the fins 444 to an ambient environment. The heatsink 440 includes a first end 441 arranged proximate to the base end 411 of the bulb 410, and includes a second end 442 arranged between the first end 441 and the at least one solid state emitter 420. The widest portion 445 of the heatsink 440 is arranged between the first end 441 and the second end 442. Width of the heatsink 440 proximate to the at least one solid state emitter 420 is small, and such width increases with distance away from the emitter 420 to the widest point 445; below the widest point 445, the width of the heatsink 440 decreases with distance away from the emitter 420. Compared to a traditional heatsink, the reverse angled heatsink 440 reduces obstruction of light generated by the solid state emitter 420.

One embodiment of the present invention includes a light fixture with at least one solid state lighting device as disposed herein. In one embodiment, a light fixture includes a plurality of solid state lighting devices. In one embodiment, a light fixture is arranged for recessed mounting in ceiling, wall, or other surface. In another embodiment, a light fixture is arranged for track mounting. A solid state lighting device may be may be permanently mounted to a structure or vehicle, or constitute a manually portable device such as a flashlight.

In one embodiment, an enclosure comprises an enclosed space and at least one solid state lighting device or light fixture as disclosed herein, wherein upon supply of current to a power line, the at least one lighting device illuminates at least one portion of the enclosed space. In another embodiment, a structure comprises a surface or object and at least one solid state lighting device as disclosed herein, wherein upon supply of current to a power line, the solid state lighting device illuminates at least one portion of the surface or object. In another embodiment, a solid state lighting device as disclosed herein may be used to illuminate an area comprising at least one of the following: a swimming pool, a room, a warehouse, an indicator, a road, a vehicle, a road sign, a billboard, a ship, a toy, an electronic device, a household or industrial appliance, a boat, and aircraft, a stadium, a tree, a window, a yard, and a lamppost.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Any features disclosed herein are intended to be combinable with other features disclosed herein unless otherwise indicated. Correspondingly, the invention as hereinafter claimed is intended to be broadly construed and interpreted, as including all such variations, modifications and alternative embodiments, within its spirit and scope.

What is claimed is:

1. A solid state lighting device comprising:

a base end;

at least one solid state emitter; and a heatsink disposed between the base end and the at least one solid state emitter, and arranged to dissipate heat generated by the at least one solid state emitter;

wherein:

the heatsink has a first end proximate to the base end, and has a first width at the first end;

the heatsink has a second end disposed between the base end and the at least one solid state emitter, and has a second width at the second end; and at least a portion of the heatsink disposed between the first end and the second end has a third width that is greater than the second width.

2. The solid state lighting device of claim 1, wherein the base end comprises at least one electrical contact.

3. The solid state lighting device of claim 1, wherein the at least one solid state emitter is disposed under or within a cover.

4. The solid state lighting device of claim 3, wherein the cover comprises a diffuser arranged to diffuse light emitted by the at least one solid state emitter.

5. The solid state lighting device of claim 3, wherein the cover is arranged as a substantially spherical or semi-spherical globe.

6. The solid state lighting device of claim 1, having a substantially central axis extending in a direction between the base end and an emitter mounting area, wherein the heatsink is arranged to permit unobstructed emission of light generated by the at least one solid state emitter according to each emission half-angle of greater than 90 degrees relative to the substantially central axis around an entire lateral perimeter of the solid state lighting device.

7. The solid state lighting device of claim 1, having a substantially central axis extending in a direction between the base end and an emitter mounting area, wherein the heatsink is arranged to permit unobstructed emission of light generated by the at least one solid state emitter according to each emission half-angle of at least about 120 degrees relative to the substantially central axis around an entire lateral perimeter of the solid state lighting device.

8. The solid state lighting device of claim 1, having a substantially central axis extending in a direction between the base end and an emitter mounting area, wherein the heatsink is arranged to permit unobstructed emission of light generated by the at least one solid state emitter according to each emission half-angle of at least about 135 degrees relative to the substantially central axis around an entire lateral perimeter of the solid state lighting device.

9. The solid state lighting device of claim 1, having a substantially central axis extending in a direction between the base end and an emitter mounting area, wherein the heatsink provides an asymmetrical optical obstruction profile relative to the substantially central axis.

10. The solid state lighting device of claim 1, wherein the heatsink comprises a plurality of fins.

11. The solid state lighting device of claim 10, wherein the plurality of fins includes fins arranged as outwardly-protruding pins or rods.

12. The solid state lighting device of claim 10, wherein the plurality of fins includes fins arranged substantially parallel to a substantially central axis defined through the base end and an emitter mounting area.

13. The solid state lighting device of claim 10, wherein the plurality of fins includes fins arranged substantially perpendicular to a substantially central axis defined through the base end and an emitter mounting area.

14. The solid state lighting device of claim 1, wherein the heatsink comprises at least one fin arranged in a spiral shape.

15. The solid state lighting device of claim 1, wherein the heatsink comprises a heatpipe.

16. The solid state lighting device of claim 1, wherein the heatsink is adapted to dissipate a steady state thermal load of at least about 2 watts in an ambient air environment of about 35° C. while maintaining a junction temperature of the at least one solid state emitter at or below about 85° C.

17. The solid state lighting device of claim 1, comprising any of a plurality of electrical conductors and a plurality of electrical circuit elements disposed within the heatsink.

18. The solid state lighting device of claim 1, being sized and shaped in accordance with ANSI Standard C.78.20-2003 for A19 bulbs.

19. A lamp or light fixture comprising the solid state lighting device of claim 1.

20. A solid state lighting device comprising:

a base end;

at least one solid state emitter; and a heatsink disposed between the base and the at least one solid state emitter, and arranged to dissipate heat generated by the at least one solid state emitter;

wherein the lighting device has a substantially central axis extending in a direction between the base end and an emitter mounting area in which the at least one solid state emitter is mounted;

wherein the heatsink is arranged to permit unobstructed emission of light generated by the at least one solid state emitter according to each emission half-angle of greater than 90 degrees relative to the central axis around an entire lateral perimeter of the solid state lighting device.

21. The solid state lighting device of claim 20, wherein the heatsink is arranged to permit unobstructed emission of light generated by the at least one solid state emitter according to each emission half-angle of at least about 120 degrees relative to the central axis around an entire lateral perimeter of the solid state lighting device.

22. The solid state lighting device of claim 20, wherein the heatsink is arranged to permit unobstructed emission of light generated by the at least one solid state emitter according to each emission half-angle of at least about 135 degrees relative to the central axis around an entire lateral perimeter of the solid state lighting device.

23. The solid state lighting device of claim 20, wherein the at least one solid state emitter is disposed under or within a cover.

24. The solid state lighting device of claim 20, wherein the base end comprises at least one electrical contact.

25. The solid state lighting device of claim 20, wherein the heatsink comprises a plurality of fins.

26. The solid state lighting device of claim 25, wherein the plurality of fins includes fins arranged as outwardly-protruding pins or rods.

27. The solid state lighting device of claim 25, wherein the plurality of fins includes fins arranged substantially parallel to a substantially central axis defined through the base end and an emitter mounting area.

28. The solid state lighting device of claim 25, wherein the plurality of fins includes fins arranged substantially perpendicular to a substantially central axis defined through the base end and an emitter mounting area.

29. The solid state lighting device of claim 20, wherein the heatsink comprises at least one fin arranged in a spiral shape.

30. The solid state lighting device of claim 20, wherein the heatsink comprises a heatpipe.

31. The solid state lighting device of claim 20, wherein the heatsink comprises a plurality of fins in conductive thermal communication with the heatpipe.

32. The solid state lighting device of claim 20, wherein the heatsink is adapted to dissipate a steady state thermal load of at least about 2 watts in an ambient air environment of about 35° C. while maintaining a junction temperature of the at least one solid state emitter at or below about 85° C.

33. The solid state lighting device of claim 20, comprising any of a plurality of electrical conductors and a plurality of electrical circuit elements disposed within the heatsink.

34. The solid state lighting device of claim 20, being sized and shaped in accordance with ANSI Standard C.78.20-2003 for A19 bulbs.

35. A lamp or light fixture comprising the solid state lighting device of claim 20.

* * * * *

UNITED STATES PATENT AND TRADEMARK OFFICE

CERTIFICATE OF CORRECTION

PATENT NO. : 8,227,961 B2
APPLICATION NO. : 12/794559
DATED : July 24, 2012
INVENTOR(S) : Antony Paul van de Ven It is certified that error appears in the above-identified patent and that said Letters Patent is hereby corrected as shown below:

On the title page under item (56), References Cited, Foreign Patent Documents, second column, add:
-- KR 10-0951781 B1 4/2010 --

Signed and Sealed this
Eighth Day of October, 2013

Teresa Stanek Rea

Teresa Stanek Rea
*Deputy Director of the United States Patent and Trademark Office*